US006033066A

United States Patent [19]

Koike et al.

[11] Patent Number: 6,033,066

[45] Date of Patent: Mar. 7, 2000

[54] INK-JET TEXTILE PRINTING PROCESS

[75] Inventors: Shoji Koike; Tomoya Yamamoto, both of Yokohama, Japan

[73] Assignee: Canon Kabushiki Kaisha, Tokyo, Japan

[21] Appl. No.: 08/008,289

[22] Filed: Jan. 25, 1993

[30] Foreign Application Priority Data

Jan. 27, 1992 [JP] Japan ..... 4-012093

[51] Int. Cl.[7] ..... B41J 2/01

[52] U.S. Cl. ..... 347/101; 347/106

[58] Field of Search ..... 346/140 R, 1.1; 347/20, 43, 100, 105, 106, 101; 106/20 D, 31.13; 358/502

[56] References Cited

U.S. PATENT DOCUMENTS

| | | | |
|---|---|---|---|
| 4,481,244 | 11/1984 | Haruta et al. | 347/105 X |
| 4,542,059 | 9/1985 | Toganoh et al. | 347/105 X |
| 4,631,548 | 12/1986 | Milbrandt . | |
| 4,702,742 | 10/1987 | Iwata et al. | 8/495 |
| 4,725,849 | 2/1988 | Koike et al. | 346/1.1 |
| 4,849,770 | 7/1989 | Koike et al. | 346/1.1 |
| 4,864,328 | 9/1989 | Fischbeck . | |
| 4,931,810 | 6/1990 | Iwata et al. | 347/100 X |
| 4,969,951 | 11/1990 | Koike et al. | 106/22 |
| 5,067,980 | 11/1991 | Koike et al. | 106/22 |
| 5,075,699 | 12/1991 | Koike et al. | 346/1.1 |
| 5,396,275 | 3/1995 | Koike et al. | 347/101 |

FOREIGN PATENT DOCUMENTS

| | | | |
|---|---|---|---|
| 57-109095 | 7/1982 | Japan . | |
| 58-53445 | 3/1983 | Japan . | |
| 60-19582 | 1/1985 | Japan . | |
| 62-161541 | 7/1987 | Japan | 347/43 |

OTHER PUBLICATIONS

Derwent (WPIL) Abstract No. 87–338767 with respect to Japanese Patent Document No. 62243890 (Oct. 24, 1987).

*Primary Examiner*—N. Le
*Assistant Examiner*—Hai C. Pham
*Attorney, Agent, or Firm*—Fitzpatrick, Cella, Harper & Scinto

[57] ABSTRACT

Provided is an ink-jet textile printing process imparting an ink to a cloth by ink-jet recording, which process comprises (a) forming a mixed color area made of at least two different colors on the cloth by ejecting successively ink droplets using at least one of an yellow ink and a black ink and at least one ink selected from the group consisting of a red ink, a green ink and a blue ink, the adhered quantity of corresponding dyes in the mixed color area being from 0.025 to 1 mg/cm$^2$; (b) dyeing the cloth having been subjected to the step (a) with the dyes adhered to the cloth by subjecting to a heat treatment; and (c) washing the cloth having been subjected to the step (b), to remove from said cloth a dye or dyes having not been adsorbed or fixed; and the mixed color area is formed by ejecting ink droplets in the order initiated with a black ink and terminated with an yellow ink.

8 Claims, No Drawings

INK-JET TEXTILE PRINTING PROCESS

BACKGROUND OF THE INVENTION

1. Field of the Invention

The present invention relates to a process for the dyeing or the textile-printing on cloths by an ink-jet method.

2. Related Background Art

Screen textile printing and roller textile printing are presently prevailing as textile printing. These methods, however, are not suited for the multi-item and small-quantity production and cannot quickly respond to fashion with ease. Accordingly, there is a recent demand for establishing electronic textile printing systems that require no printing plates. To answer such a demand, a number of proposals have been made on textile printing carried out by ink-jet printing, which increasingly attracts expectations from various fields.

Inks for ink-jet textile printing are required to satisfy the following:

(1) They impart densities sufficient for color formation.

(2) They have a high color yield to cloths and enable easy effluent treatment after the step of washing.

(3) They cause less irregular bleeding on cloths when different colors are mixed.

(4) They can achieve color reproduction in a wide range.

(5) They allow simpler process management.

In order to satisfy these requirements, it has been hitherto mainly attempted to add various additives to inks, to control ink-shot quantities and to apply a pretreatment to cloths. Using these methods only, however, it has been impossible to satisfy the requirement (3) or (4).

Though not concerned with cloths, a method that can satisfy the requirement (3) includes, for example, methods in which the order of ink-shot is controlled as disclosed in Japanese Patent Application Laid-open No. 60-19582 and No. 62-161541, and a method that can satisfy the requirement (4) includes methods in which specialty color inks are used in addition to cyan, magenta and yellow colors as disclosed in Japanese Patent Application Laid-open No. 57-109095 and No. 58-53445. In the case of cloths, however, situation is different from the recording on paper, and there are differences in color yield of dyes to-cloths or changes in lightness after dyeing. Moreover, in methods making use of red, green and blue inks, the bleeding at mixed color areas may become more problematic, and it has been difficult to better satisfy the requirements (3) and (4) than in the case of the recording on paper.

In addition, the textile printing on cloths requires finally a washing step to remove dyes having not been adsorbed or fixed in cloths, and must be handled in a different way than in the case of the usual recording on paper that requires no conventional washing step.

As discussed above, some conventional techniques can provide measures by which some of the requirements or performances can be satisfied individually. Under existing circumstances, however, no ink-jet color textile printing processes are known until now which can satisfy these performances at the same time, can solve a series of problems and makes it possible to obtain prints of the highest grade.

SUMMARY OF THE INVENTION

Accordingly, an object of the present invention is to provide a textile printing process that can satisfy the aforesaid requirements hitherto commonly made in ink-jet textile printing, i.e., the requirements to obtain sharp, highly dense and highly precise dyed articles.

Another object of the present invention is to provide a textile printing process that can achieve a high color yield, in order to solve the problem that dyes are used in a large quantity because of a low color yield of dyes in conventional methods such as screen textile printing and roller textile printing making use of a thickner, resulting in effluence of dyes during the washing step to cause an environmental pollution.

The above objects of the present invention can be achieved by the invention described below.

The present invention provides an ink-jet color textile printing process imparting an ink to a cloth by an ink-jet method, which process comprises at least the following three steps of (a) forming a mixed color area made of at least two different colors on said cloth by ejecting successively ink droplets using at least one of an yellow ink and a black ink and at least one ink selected from the group consisting of a red ink, a green ink and a blue ink, the adhered quantity of corresponding dyes in said mixed color area being from 0.025 to 1 mg/cm$^2$;

(b) dyeing said cloth having been subjected to the step (a), with the dyes adhered to said cloth by subjecting to a heat treatment; and (c) washing said cloth having been subjected to the step (b), to remove from said cloth a dye or dyes having not been adsorbed or fixed; and said mixed color area is formed by ejecting ink droplets in the order initiated with a black ink and terminated with an yellow ink.

The present invention also provides a textile-printed article having been textile-printed by the above ink-jet color textile printing process.

The present invention further provides a process for producing a textile-printed article, comprising producing a textile-printed cloth by the above ink-jet color textile printing process.

DESCRIPTION OF THE PREFERRED EMBODIMENTS

The present inventors have made studies in order to find a way to satisfy all the aforesaid required performances at the same time in ink-jet color textile printing processes. As a result, they have discovered that controlling the quantity of dyes imparted to a cloth and definitely controlling the order of shooting inks used in combination of specific colors can bring about improvements in levelness and color yield, in particular, a remarkable improvement in color forming performance such as anti-bleeding at mixed color areas in which different colors are mixed, irrespective of some difference in the thickness of cloths or the structure of fibers (fiber length, fiber diameter, average number of twist, etc.) constituting the cloths. More specifically, in a combination in which an yellow ink and a black ink are essential and at least a red ink, a green ink and a blue ink are used, what is intended can be achieved by shooting them in the order initiated with the black ink and terminated with the yellow ink. As a factor thereof, it can be said that a dot imparted to a cloth or an image constituted of the dot has a structure wherein the center is formed of a color having a high contrast to the cloth and giving a high sense of sight to humans, such as black, and the margin is formed of a color having a low contrast to the cloth and giving a low sense of sight, such as yellow, and hence can be hardly perceived by human eyes even if the yellow is formed thick. In ink-jet textile printing, however, the order of shooting a red ink, a green ink and a blue ink is particularly important, and it is necessary to shoot them in the state they are put between black ink and an yellow ink.

The reason therefor is uncertain, but can be considered to be concerned with the fact that the three primary colors as red, green and blue in additive color mixture, when they are in the state of a well balanced color formation, have a lower maximum absorption peak of light absorption spectrum than the three primary colors as yellow, magenta and cyan in subtractive color mixture, making the spectrum itself broad, and hence tend to be more remarkably influenced by the order of overlaying of black than the three primary colors in the subtractive color mixture. For this reason, it is presumed that no good color formation of red, green and blue can be achieved when the black ink, having absorption in all the visual region, is shot later.

With regard to the yellow ink, it can be less influenced by other inks since it has a sharp absorption, having a reasonably large maximum absorption at around 400 nm. It, however, is presumed that it is more preferable for the yellow ink to be shot later than the inks having a broad absorption, such as a red ink, a green ink and a blue ink, in view of well balanced color formation, too.

They have also discovered that, when there is a possibility of faulty images caused by bleeding or the like that may occur during the step of dyeing carried out using vapor, such faulty images caused by bleeding can be made little perceivable by controlling shot quantity of dyes.

In the present invention, the shot quantity of dyes is a very great factor, and the object of the present invention cannot be achieved if it is outside a definite scope.

The present invention will be described below in greater detail by giving preferred embodiments of the invention.

A material that constitutes the cloth used in the present invention may include natural fibers such as cotton and silk and synthetic fibers such as nylon and polyester. In particular, natural fibers such as cotton and silk are preferred. These fibers can be used in the form of any of woven fabric, knitted web and nonwoven fabric.

As physical properties of the fibers, in general, cloths formed of yarn or fiber having a larger length, a smaller diameter and a larger number of twist are more preferable.

For example, in the case of a cloth mainly formed of cellulose fiber, it is preferable to use a cloth formed of fibers having an average fiber length of from 25 to 60 mm, an average fiber diameter of from 0.6 to 2.2 d and an average twist of from 70 to 150/cm; and in the case of a cloth mainly containing silk fibers, a cloth having an average yarn diameter of from 14 to 147 d and an average fiber diameter of from 2.5 to 3.5 d.

In order to obtain better textile printed articles, the cloth described above may preferably be subjected to a conventional pretreatment. In particular, it is more preferable to use a cloth made to contain from 0.01 to 5% by weight of an alkaline material or a cloth made to contain from 0.01 to 20% by weight of a substance selected from the group consisting of a water-soluble metal salt, a water-soluble polymer, a synthetic polymer, urea and thiourea.

The alkaline materials may include, for example, alkali metal hydroxides such as sodium hydroxide and potassium hydroxide, amines such as mono-, di- or triethanolamine, and alkali metal carbonates or hydrogencarbonate such as sodium carbonate, potassium carbonate and sodium hydrogencarbonate. It may also include organic acid metal salts such as calcium acetate and barium acetate, or ammonia and ammonia compounds. It is also possible to use sodium trichloroacetate, capable of being converted into an alkaline material under steaming and dry heating. Particularly preferable alkaline materials are sodium carbonate and sodium bicarbonate used when dyeing with reactive dyes.

The water-soluble polymers may include natural water-soluble polymers as exemplified by starch type materials such as corn and wheat, cellulose type materials such as carboxymethyl cellulose, methyl cellulose and hydroxyethyl cellulose, polysaccharides such as sodium alginate, gum arabic, locust bean gum, tragacanth gum, guar gum and tamarind seeds, protein type materials such as gelatin and casein, tannin type materials, and lignin type materials.

The synthetic polymers may include, for example, polyvinyl alcohol compounds, polyethylene oxide compounds, acrylic acid water-soluble polymers and maleic anhydride water-soluble polymers. In particular, polysaccharide polymers and cellulose polymers are preferred.

The water-soluble metal salts may include compounds capable of producing a typical ionic crystal and having a pH from 4 to 10, as exemplified by alkali metals and alkaline earth metals. Typical examples of such compounds are alkali metals such as NaCl, $Na_2SO_4$, KCl and $CH_3COONa$, and alkaline earth metals such as $CaCl_2$ and $MgCl_2$. In particular, salts of Na, K or Ca are preferred.

The cloth may preferably have a moisture regain slightly higher than the official regain of the fibers constituting the cloth. Its moisture regain may preferably be from 5 to 100% higher than the official regain.

The textile printing ink used in the present invention is comprised of a coloring matter, water, a water-soluble organic solvent, additives and so forth.

The coloring matters may preferably include dyes, and any dyes dyeable to the cloth can be used. It is possible to use acid dyes, direct dyes, cationic dyes, reactive dyes, disperse dyes and vat dyes. One or more kinds of these dyes are contained in the ink, and may be used in combination with a dye having a different hue. They may be used usually in an amount of from 2 to 30% by weight, preferably from 3 to 25% by weight, and more preferably from 4 to 20% by weight, in total based on the total weight of the ink.

The water, which is preferable as the main component of the ink, may be contained in an amount ranging from 10 to 93% by weight, preferably from 25 to 87% by weight, and more preferably from 30 to 80% by weight, based on the total weight of the ink.

The water-soluble organic solvents may include, for example, ketones or ketoalcohols such as acetone and diacetone alcohol; ethers such as tetrahydrofuran and dioxane; addition polymers of oxyethylene or oxypropylene such as diethylene glycol, triethylene glycol, tetraethylene glycol, dipropylene glycol, tripropylene glycol, polyethylene glycol and polypropylene glycol; alkylene glycols whose alkylene group has 2 to 6 carbon atoms, such as ethylene glycol, propylene glycol, trimethylene glycol, butylene glycol, 1,2,6-hexanetriol and hexylene glycol; thiodiglycol; glycerol; lower alkyl ethers of polyhydric alcohols such as ethylene glycol monomethyl or -ethyl ether, diethylene glycol monomethyl or -ethyl ether and triethylene glycol monomethyl or -ethyl ether; lower dialkyl ethers of polyhydric alcohols such as triethylene glycol dimethyl or -ethyl ether and tetraethylene glycol dimethyl or -ethyl ether; sulfolane, N-methyl-2-pyrrolidone, and 1,3-dimethyl-2-imidazolidinone.

The above water-soluble organic solvent may be contained usually in an amount ranging from 5% to 60% by weight, and preferably from 5% to 50% by weight, based on the total weight of the ink.

When the medium as described above is used in combination, it may be used alone or in the form of a mixture. A most preferred liquid medium is so composed that the solvent contains at least one polyhydric alcohol. In particular, thiodiglycol alone or a mixed system of diethylene glycol and thiodiglycol is particularly preferred.

As to other additive components, chloride ions and/or sulfate ions may be contained in an amount of from 10 to 20,000 ppm based on the dyes in the ink. This is preferable since color forming performances such as levelness and color yield can be more improved.

Main components of the ink used in the present invention are as described above. If necessary, other known various kinds of dispersants, surface active agents, viscosity modifiers, surface tension modifiers, fluorescent brightening agents and so forth may be added.

For example, they may include viscosity modifiers such as polyvinyl alcohol, celluloses and water-soluble resins, various surface active agents of a cationic or nonionic type, surface tension modifiers such as diethanolamine and triethanolamine, pH adjusters comprising a buffer, and antifungal agents.

As the ink-jet printing system for imparting the aforesaid inks to the cloth, it is possible to use thermal-jet method of an On-Demand system, known in the art.

In the present invention, a plurality of ink droplets are successively brought onto the above cloth by ink-jet method to form a mixed-color area which is formed of inks of at least two different colors including one color ink selected from the group of an yellow ink, a black ink, a red ink, a green ink and a blue ink. In this case, the corresponding dyes in the mixed color area are adhered in a quantity of from 0.025 to 1 mg/cm$^2$, preferably from 0.04 to 0.7 mg/cm$^2$, and preferably from 0.05 to 0.5 mg/cm$^2$, in total. This value can be determined by actually measuring ejection quantity of the ink and dye concentration in the ink. If the dyes are adhered in a quantity less than 0.025 mg/cm$^2$, it is difficult to achieve color formation at a high density, making the effect of the present invention unclear. If they are adhered in a quantity more than 1 mg/cm$^2$, the present invention can not be remarkably effective for achieving a high precision and improving the color yield.

The ink droplets must be brought onto the cloth in the following order. That is, the inks are shot in the order initiated with a black ink and terminated with an yellow ink. Inks of at least three different colors are used. In addition to a black ink and an yellow ink, it is essential to use at least one selected from a red ink, a green ink and a blue ink. Droplets of other ink such as a cyan ink, a magenta ink, an orange ink and the like may also be optionally brought onto the cloth so as to be held between the black ink and the yellow ink. The present invention includes an embodiment in which two or more of ink droplets of a red ink, a green ink and a blue ink are brought onto the cloth. Thus, it is possible to carry out ink-jet textile printing that is sharp, can be free from any conspicuous-irregular bleeding at mixed color areas and can achieve color reproduction in a wide range.

The cloth on which the mixed color areas have been thus formed is subsequently subjected to a heat treatment to dye the cloth with the dyes. The heat treatment may be applied by a conventionally known method, as exemplified by steaming, HT steaming, thermo-fixing, or, in an instance in which a cloth having been alkali-treated is not used when an alkali agent is required in fixing, alkali pad steaming, alkali blotch steaming, or alkali shock treatment. In particular, the present invention can be more remarkably effective when treated by steaming.

In the present invention, the cloth having been subjected to the above treatment is washed to remove dyes having not been adsorbed or fixed, using a conventionally known method.

EXAMPLES

The present invention will be described below in greater detail by giving Examples and Comparative Examples. In the following, "part(s)" and "%" are by weight.

I. Preparation of Inks

Reactive dye inks and acid dye inks of five different colors each were prepared.

1. Reactive Dye Inks

| | |
|---|---|
| Reactive dye | 4 to 20 parts |
| Thiodiglycol | 24 parts |
| Diethylene glycol | 11 parts |
| Potassium chloride | 0.004 part |
| Sodium sulfate | 0.002 part |
| Sodium metasilicate | 0.001 part |
| Ferric chloride | 0.0005 part |
| Water | 45 to 61 parts |

Dyes used were as follows:

Yellow ink
C.I. Reactive Yellow 95

Red ink
C.I. Reactive Red 218

Blue ink
C.I. Reactive Blue 49

Green ink
C.I. Reactive Green 8

Black ink
C.I. Reactive Black 39.

The above components were respectively mixed (the total weight of the reactive dye and the water was made to be 65 parts). The aqueous mixture obtained each was adjusted to pH 8.4 using sodium hydroxide, and stirred for 2 hours, followed by filtration using Fluoropore Filter FP-100 (trade name; available from Sumitomo Electric Industries, Ltd.) to give a water-based ink.

2. Acid Dye Inks

| | |
|---|---|
| Acid dye | 4 to 20 parts |
| Thiodiglycol | 23 parts |
| Triethylene glycol monomethyl ether | 6 parts |
| Potassium chloride | 0.05 part |
| Sodium metasilicate | 0.001 part |
| Ferric chloride | 0.0005 part |
| Zinc chloride | 0.0003 part |
| Water | 51 to 67 parts |

Dyes used were as follows:

Yellow ink
C.I. Acid Yellow 110

Red ink
C.I. Acid Red 254

Blue ink
C.I. Acid Blue 40

Green ink

C.I. Acid Green 25

Black ink

C.I. Acid Black 26.

The above components were respectively mixed (the total weight of the acid dye and the water was made to be 71 parts). The aqueous mixture obtained each was adjusted to pH 4.8 using acetic acid, and stirred for 2 hours, followed by filtration using Fluoropore Filter FP-100 (trade name; available from Sumitomo Electric Industries, Ltd.) to give a water-based in.

II. Ink-jet Dyeing Apparatus

Color Bubble-jet Copier PIXEL PRO (trade name; manufactured by Canon Corp.) was modified so as to enable control of suitable quantity of ejected liquid, and put to use.

1. Ink-jet system: On-Demand type
2. Head voltage: 20 to 40 V
3. Head temperature: 20 to 60° C.
4. Driving pulse width: 3 to 20 $\mu$s
5. Driving frequency: 0.5 to 4 kHz
6. Distance between nozzle and fabric: 1 mm
7. Recording density: 16 dots/mm×16 dots/mm (400 dots/inch×400 dots/inch).

III. Cloth

The following two kinds of fabrics were used, which were pretreated with water or by padding with a solution comprised of 20 parts of sodium alginate, 10 parts of urea and 70 parts of water, followed by adjustment of moisture regain by changing a pickup.

a. Hirajihosonuno (a Japanese term meaning plain fabric with a narrow cloth width; 100% cotton)

b. Habutae 8-monmetsuki (a Japanese term meaning 1.056-ounce glossy silk; 100% silk).

Using three reactive dye inks of a black ink, an yellow ink and one of a red ink, a blue ink and a green ink among the above inks, and using the cloth a (having been pretreated with only water), each 10 mm×20 mm rectangular solid mixed color area was printed using the above ink-jet apparatus in combination of all different colors, where dye adhesion quantity, moisture regain of cloth and ink shot order were varied as shown in Table 1. The dye adhesion quantity was controlled by varying dye concentration in each ink within the range of from 4 to 20% by weight, and also managing driving conditions (head voltage, head temperature, driving pulse width, driving frequency) of the ink-jet apparatus to change ejected droplet quantity within the range of from 20 to 50 pl and optionally making a multiple shot. The printed cloths were dried, followed by padding with a treatment solution comprised of 20 parts of sodium hydroxide, 10 parts of urea and 70 parts of water, fixing by steaming at 100° C. for 5 minutes, washing with a synthetic detergent, and then drying. Sharpness and anti-bleed properties of the textile-printed cloths thus obtained were evaluated and optical densities (OD) of solid black areas thereof were measured to be used as criteria for judging the color yield.

Results obtained are shown in Table 1. Sharpness and anti-bleeding were good when the dyes were adhered in a quantity of from 0.025 to 1 mg/cm$^2$ in total. The color yield was judged by relative evaluation of OD values to confirm that it decreased when the dyes were adhered in a quantity more than 1 mg/cm$^2$. Anti-bleeding at the mixed color areas was remarkably good and also very sharp images were obtained when a black ink was shot first and an yellow ink was shot last.

Similar experiments were also made using a cloth a having been pretreated with the aqueous solution of sodium alginate and urea. As a result, the present invention was found more remarkably effective for sharpness, anti-bleeding and OD.

TABLE 1

| | *1 Dye adhesion quantity (mg/cm$^2$) | *2 Cloth moisture regain (%) | *3 Shot order | *4 Sharpness | *5 Anti-bleeding SC | *5 Anti-bleeding MC | Average OD |
|---|---|---|---|---|---|---|---|
| Example: | | | | | | | |
| 1 | 0.025 | 21 | A | A | A | A | 0.34 |
| 2 | 0.15 | 21 | A | A | A | A | 1.21 |
| 3 | 1.0 | 21 | A | A | A | A | 1.45 |
| 4 | 0.45 | 13.5 | A | A | A | A | 1.20 |
| 5 | 0.15 | 108.5 | A | A | A | A | 1.24 |
| 6 | 0.15 | 21 | C | A | A | A | 1.21 |
| 7 | 0.15 | 21 | E | A | A | A | 1.21 |
| Comparative Example: | | | | | | | |
| 1 | 0.02 | 21 | A | B | A | A | 0.20 |
| 2 | 1.5 | 21 | A | B | C | C | 1.46 |
| 3 | 0.15 | 21 | B | C | A | C | 1.21 |
| 4 | 0.15 | 21 | D | C | A | C | 1.21 |
| 5 | 0.15 | 21 | F | C | A | C | 1.21 |

*1: Dye adhesion quantity was determined in the following way. (Ejected droplet quantity) × (dot number per 1 cm$^2$) × (dye concentration in ink) × (number of multiple shots)

*2: Moisture regain of cloth was measured making reference to JIS L 1019. More specifically, 100 g of sample was exactly weighed, put in a dryer of 105 ± 2° C. and dried therein until it reached its constant weight. The moisture regain of the cloth was determined according to the following expression. Moisture regain (%) = {(W − W')/W'} × 100 wherein W is weight before drying, and W' is weight after drying.As to the cloth having been pretreated with a water-soluble polymer or the like, the cloth was dried until it reached its constant weight, thereafter washed with water, and again dried until it reached its constant weight. Then, the weight after drying, of only fibers of the cloth was measured, and the moisture regain of the cloth was determined according to the following expression. Moisture regain (%) = {(W − W')/W"} × 100wherein W" is weight after washing and drying.

*3: Shot order A: In order of black, red, yellow. Shot order B: In order of yellow, red, black. Shot order C: In order of black, blue, yellow. Shot order D: In order of yellow, blue, black. Shot order E: In order of black, green, yellow. Shot order F: In order of yellow, green, black.

*4: Density and levelness at solid mixed color areas were observed with the naked eye to judge the sharpness. A: High density and excellent levelness. B: There is a problem in any of density and levelness. C: There is a problem in both density and levelness.

*5: Any irregular disorders at straight portions of boundary edges of solid single color (SC) areas and solid mixed color (MC) areas were observed with the naked eye to judge the anti-bleeding. A: There is no disorder at all. B: There is a little disorder. C: There is much disorder.

Using three acid dye inks of a black ink, an yellow ink and one of a red ink, a blue ink and a green ink among the above inks, and using the cloth b (having been pretreated with only water), printing was carried out using the same ink-jet apparatus, where dye adhesion quantity, moisture regain of cloth and ink shot order were varied as shown in Table 2, in the same manner as in Example 1. Thereafter, steaming was carried out at 100° C. for 5 minutes, followed by washing and then drying. Sharpness and anti-bleed properties of the textile-printed cloths thus obtained were evaluated and optical density (OD) was measured to be used as criteria for judging the color yield. Results obtained are shown in Table 2. Substantially the same results as those in Examples shown in Table 1 were obtained.

Similar experiments were also made using a cloth b having been pretreated with the aqueous solution of sodium alginate and urea. As a result, the present invention was found more remarkably effective for sharpness, anti-bleeding and OD.

TABLE 2

| | *1 Dye adhesion quantity (mg/cm²) | *2 Cloth moisture regain (%) | *3 Shot order | *4 Sharpness | *5 Anti-bleeding SC | *5 Anti-bleeding MC | Average OD |
|---|---|---|---|---|---|---|---|
| Example: | | | | | | | |
| 8 | 0.025 | 30 | A | A | A | A | 0.27 |
| 9 | 0.15 | 30 | A | A | A | A | 1.24 |
| 10 | 1.0 | 30 | A | A | A | A | 1.48 |
| 11 | 0.15 | 17 | A | A | A | A | 1.22 |
| 12 | 0.15 | 112 | A | A | A | A | 1.21 |
| 13 | 0.15 | 30 | C | A | A | A | 1.24 |
| 14 | 0.15 | 30 | E | A | A | A | 1.24 |
| Comparative Example: | | | | | | | |
| 6 | 0.02 | 30 | A | B | A | A | 0.21 |
| 7 | 1.5 | 30 | A | B | C | C | 1.47 |
| 8 | 0.15 | 30 | B | C | A | C | 1.24 |
| 9 | 0.15 | 30 | D | C | A | C | 1.24 |
| 10 | 0.15 | 30 | F | C | A | C | 1.24 |

*1: Dye adhesion quantity was determined in the following way. (Ejected droplet quantity) × (dot number per 1 cm²) × (dye concentration in ink) × (number of multiple shots)

*2: Moisture regain of cloth was measured making reference to JIS L 1019. More specifically, 100 g of sample was exactly weighed, put in a dryer of 105 ± 2° C. and dried therein until it reached its constant weight. The moisture regain of the cloth was determined according to the following expression. Moisture regain (%) = {(W − W')/W"} × 100 wherein W is weight before drying, and W' is weight after drying.As to the cloth having been pretreated with a water-soluble polymer or the like, the cloth was dried until it reached its constant weight, thereafter washed with water, and again dried until it reached its constant weight. Then, the weight after drying, of only fibers of the cloth was measured, and the moisture regain of the cloth was determined according to the following expression. Moisture regain (%) = {(W − W')/W"} × 100wherein W" is weight after washing and drying.

*3: Shot order A: In order of black, blue, yellow. Shot order B: In order of yellow, blue, black. Shot order C: In order of black, red, yellow. Shot order D: In order of yellow, red, black. Shot order E: In order of black, green, yellow. Shot order F: In order of yellow, green, black.

*4: Density and levelness at solid mixed color areas were observed with the naked eye to judge the sharpness. A: High density and excellent levelness. B: There is a problem in any of density and levelness. C: There is a problem in both density and levelness.

*5: Any irregular disorders at straight portions of boundary edges of solid single color (SC) areas and solid mixed color (MC) areas were observed with the naked eye to judge the anti-bleeding. A: There is no disorder at all. B: There is a little disorder. C: There is much disorder.

As described above, the color textile printing process of the present invention making use of ink-jet method makes it possible to obtain bleeding-free, sharp, highly dense and highly precise dyed articles.

The present invention can also bring about a remarkable improvement in the color yield in the color textile printing making use of ink-jet recording, and can afford to cope with the problem of environmental pollution due to effluents.

What is claimed is:

1. An ink-jet color textile printing process for producing a cloth having an image including a black image, a first color image of yellow and a second color image of a color selected from the group consisting of red, green and blue, the first and second color images overlapping with the black image, comprising the steps of:

(a) providing a cloth having a moisture regain higher than an official regain of fibers constituting the cloth by 5 to 100 percent by weight;

(b) providing a black ink containing a black dye, a yellow ink containing a yellow dye and a color ink selected from the group consisting of a red ink containing a red dye, a green ink containing a green dye, and a blue ink containing a blue dye;

(c) applying the black ink, the yellow ink and the color ink on the cloth provided in step (a);

(d) subjecting the cloth resulting from step (c) to a heat treatment and fixing the dyes in the respective inks; and (e) washing the cloth resulting from step (d) and forming the black image, the first color image and the second color image on the cloth, wherein the step (c) comprises the sub-steps of:

(i) applying the black ink to a portion on the cloth where the black image is formed with an ink-let printer;

(ii) applying the color ink to a portion on the cloth where the second color image is formed with the ink-jet printer; and (iii) applying the yellow ink to a portion on the cloth where the first color image is formed with the ink-jet printer;

wherein the sub-steps (i), (ii) and (iii) are conducted in this order, and wherein an amount of dyes attached to a portion on the cloth where the black image, the first color image and the second color image are overlapped, ranges from 0.025 to 1 mg/cm².

2. The ink-jet color textile printing process according to claim 1, wherein the amount of dyes attached to a portion on the cloth where the black image, the first color image and the second color image are overlapped, ranges from 0.04 mg/cm² to 0.7 mg/cm².

3. The ink-jet color textile printing process according to claim 1, wherein the amount of dyes attached to a portion on the cloth where the black image, the first color image and the second color image are overlapped, ranges from 0.05 mg/cm² to 0.5 mg/cm².

4. The ink-jet color textile printing process according to claim 1, wherein said inks contain at least one of a chloride ion and a sulfate ion at a concentration of from 10 ppm to 20,000 ppm based on the dyes contained in the inks.

5. The ink-jet color textile printing process according to claim 1, wherein said inks contain a solvent comprising thiodiglycol or a mixed solvent of thiodiglycol and diethylene glycol.

6. The ink-jet color textile printing process according to claim 1, which further comprises the step of carrying out a pretreatment of said cloth before said step (a).

7. The ink-jet color textile printing process according to claim 1, wherein the respective inks are applied on the cloth in step (c) with an on-demand ink-jet printer.

8. The ink-jet color textile printing process according to claim 1, wherein the respective inks are applied on the cloth by applying heat energy to the respective inks.

* * * * *